US006547293B1

(12) United States Patent
Cheng

(10) Patent No.: US 6,547,293 B1
(45) Date of Patent: Apr. 15, 2003

(54) CASE LOCK

(76) Inventor: Ching-Yuan Cheng, No. 64-5, Alley 70, Lane 419, Betiuen Rd., Betiuen Chiu, Taichung (TW)

( * ) Notice: Subject to any disclaimer, the term of this patent is extended or adjusted under 35 U.S.C. 154(b) by 0 days.

(21) Appl. No.: 10/101,705

(22) Filed: Mar. 21, 2002

(51) Int. Cl.[7] ..... E05C 19/14; E05C 5/00

(52) U.S. Cl. ..... 292/247; 292/113; 292/DIG. 49; 292/DIG. 48; 292/DIG. 50; 70/73; 70/76

(58) Field of Search ..... 292/247, 113, 292/DIG. 49, DIG. 48, DIG. 50; 70/73, 76; 190/114, 119–121

(56) References Cited

U.S. PATENT DOCUMENTS

| | | | | | |
|---|---|---|---|---|---|
| 1,522,179 | A | * | 1/1925 | Garrigus | 292/247 |
| 2,635,910 | A | * | 4/1953 | Celeste | 292/247 |
| 2,672,040 | A | * | 3/1954 | Komenak | 70/76 |
| 2,795,946 | A | * | 6/1957 | Check | 70/76 |
| 2,829,912 | A | * | 4/1958 | Koch | 292/114 |
| 3,030,137 | A | * | 4/1962 | Cheney | 292/113 |
| 3,321,230 | A | * | 5/1967 | Stollman | 292/113 |
| 3,434,314 | A | * | 3/1969 | Atkinson | 70/76 |
| 3,584,906 | A | * | 6/1971 | Budzyn | 292/247 |
| 3,698,753 | A | * | 10/1972 | Atkinson | 292/247 |
| 3,885,407 | A | * | 5/1975 | Feinberg | 70/76 |
| 4,008,584 | A | * | 2/1977 | Wingert | 70/73 |
| 4,074,549 | A | * | 2/1978 | Lee | 70/7 |
| 4,300,794 | A | * | 11/1981 | Dunsmoor | 292/247 |
| 4,509,622 | A | * | 4/1985 | Morszeck | 190/119 |
| 4,627,650 | A | * | 12/1986 | Hauschulte | 292/113 |
| 4,679,833 | A | | 7/1987 | Dueringer | |
| 5,438,853 | A | * | 8/1995 | Bartsch | 70/69 |
| 6,032,988 | A | * | 3/2000 | Klein | 292/247 |
| 6,102,455 | A | * | 8/2000 | Schurman | 292/249 |

* cited by examiner

*Primary Examiner*—J. J. Swann
*Assistant Examiner*—Matthew E. Rodgers
(74) *Attorney, Agent, or Firm*—Browdy and Neimark, P.L.L.C.

(57) ABSTRACT

A case lock is disclosed to include a fixed retaining member and a movable lock body assembly respectively fastened to the top and bottom cover shells of a case for locking the case. The movable lock body assembly includes a front cover, an actuating member pivoted to the front cover, a sliding retainer, a link pivoted between the actuating member and the sliding retainer and adapted to move the sliding retainer in an axial direction while the link is driven by the actuating member and moved along with said actuating member, and a back cover covered on the front cover and defining with the front cover a space in which the actuating member, the link and the sliding retainer are positioned.

11 Claims, 5 Drawing Sheets

CASE LOCK

FIELD OF THE INVENTION

The present invention relates to locks, and, more specifically, to a case lock for use in a suitcase, trunk, or the like.

BACKGROUND OF THE INVENTION

U.S. Pat. No. 4,679,833 discloses a lock for use in a case. This design of case lock comprises a fixed lock member and a movable lock body assembly. The movable lock body assembly comprises a bottom panel, an actuating member pivoted to the bottom panel, a retainer member for engaging the fixed lock member, and a link coupled between the retainer member and the actuating member. This design of case lock is still not satisfactory in function. When the user unlocked the case lock and opened the case, the retainer member of the lock body assembly has a part protruded over the top side of the case. The protruded part of the retainer member may injure the user's hands or damage the storage items when the user take out the storage items from the case.

SUMMARY OF THE INVENTION

The primary objective of the present invention is to provide a case lock, which keeps the movable members of the lock body assembly received below the elevation of the top side of the case when the user opened the case, preventing inconvenience to the user.

To achieve the objective of the present invention, the case lock comprises a fixed retaining member and a movable lock body assembly respectively fastened to the top and bottom cover shells of a case for locking the case. The fixed retaining member has an engagement block adapted for engaging into the movable lock body assembly when closing the top and bottom cover shells of the case. The movable lock body assembly comprises a front cover having a receiving recess, an actuating member pivoted to the front cover, a sliding retainer, a link and a back cover. The sliding retainer has an opening in middle section thereof, a front bar, a recessed portion in a top side of the front bar for engagement with the engagement block of the fixed retaining member, and a beveled face in a bottom side of the front bar. The sliding retainer is covered with its top side on the back side of the actuating member. The link is pivoted between the actuating member and the sliding retainer and adapted to move the sliding retainer in an axial direction while the link is driven by the actuating member. The back cover is covered on the bottom side of the front cover such that the back cover defines with the front cover a space, which receives the actuating member, the link, and the sliding retainer.

DETAILED DESCRIPTION OF THE INVENTION

Figure 2:
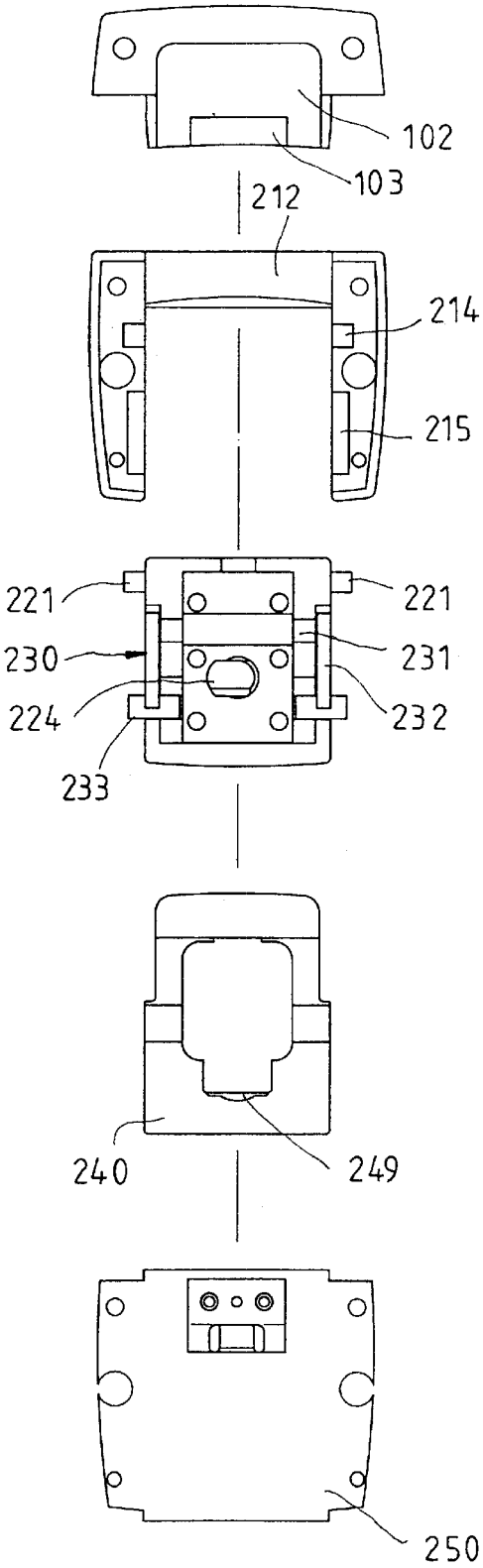
FIG. 2 is a rear view of FIG. 1.

Referring to FIGS. from 1 through 3, a case lock is shown comprised of a fixed retaining member 100 and a movable lock body assembly 200 respectively fastened to the top and bottom cover shells of a case (for example, a suitcase or trunk). The fixed retaining member 100 is an elongated member having an extension portion 101 outwardly protruded from the middle part, a recessed receiving portion 102 formed in the bottom side of the extension portion 101, and an engagement block 103 downwardly protruded from the bottom side of the free end of the extension portion 101. When closing the top and bottom cover shells of the case, the extension portion 101 of the fixed retaining member 100 is forced into the movable lock body assembly 200 and locked.

The movable lock body assembly 200 is comprised of a front cover 210, an actuating member 220, a link 230, a sliding retainer 240, and a back cover 250.

The front cover 210 comprises a transverse shoulder 211, and two arms 213 respectively extended from the ends of the transverse shoulder 211 at right angles in same direction. The transverse shoulder 211 has a receiving recess 212 in the bottom side. The arms 213 each have a coupling hole 214 and a longitudinal sliding groove 215 respectively disposed in the bottom side.

The actuating member 220 is a rectangular member comprising two side pivots 221 symmetrically disposed at two sides near one end and respectively pivoted to the coupling holes 214 of the front cover 210 for enabling the actuating member 220 to be received in between the arms 213 of the front cover 210. The actuating member further comprises a keyway 222 in the front side, a lock cylinder 223 in the back side, and a swivel hook 224 coupled to the lock cylinder 223.

Figure 5:
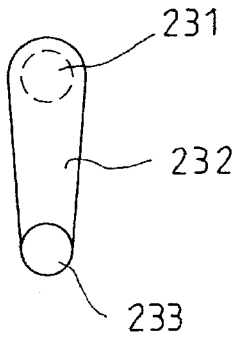
FIG. 5 is a side view of the link of the preferred embodiment of the present invention.
Figure 4:
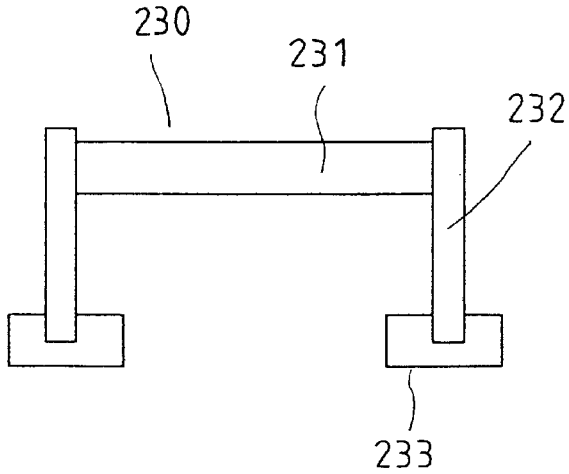
FIG. 4 is a front view of the link of the preferred embodiment of the present invention.

The link 230, as shown in FIGS. 2, 4, and 5, comprises a pivot axle 231 pivoted to the back side of the actuating member 220, and two arm rods 232 respectively connected to the ends of the pivot axle 231 and arranged in parallel. The arm rods 232 each have the respective free end terminating in a respective coupling portion 233 respectively positioned in the longitudinal sliding grooves 215 of the arms 213. According to this embodiment, the link is a unitary device. Alternatively, the link can be formed of two separated members.

Figure 1:
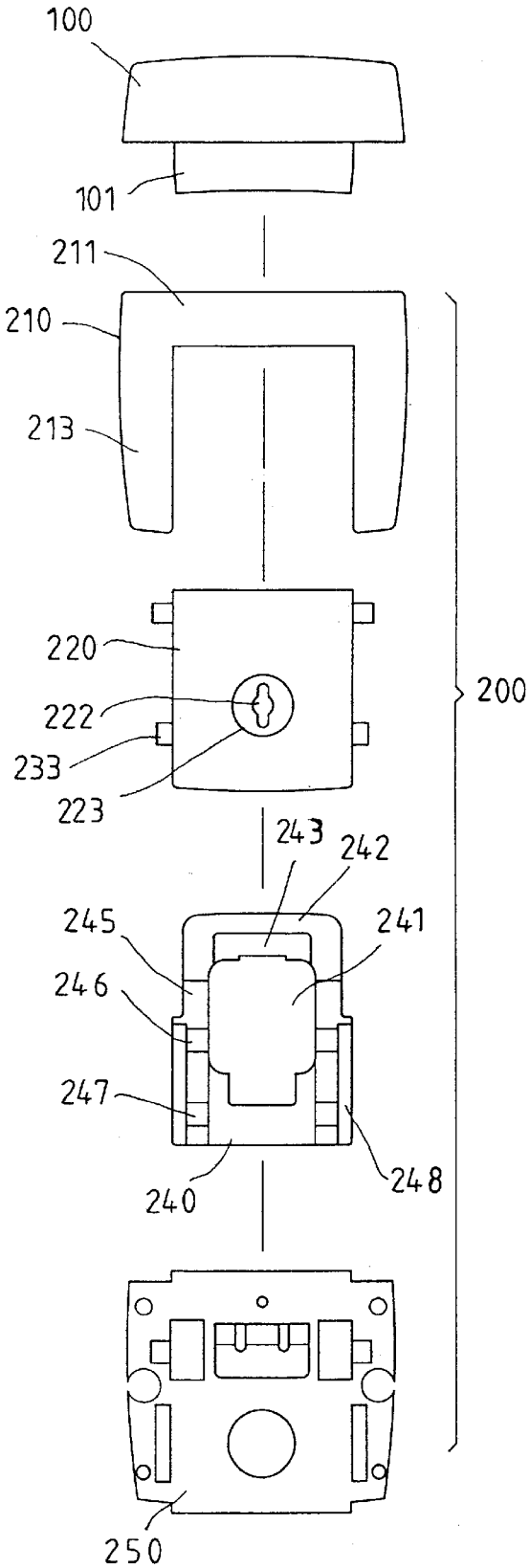
FIG. 1 is an exploded front view of a preferred embodiment of the present invention.
Figure 3:
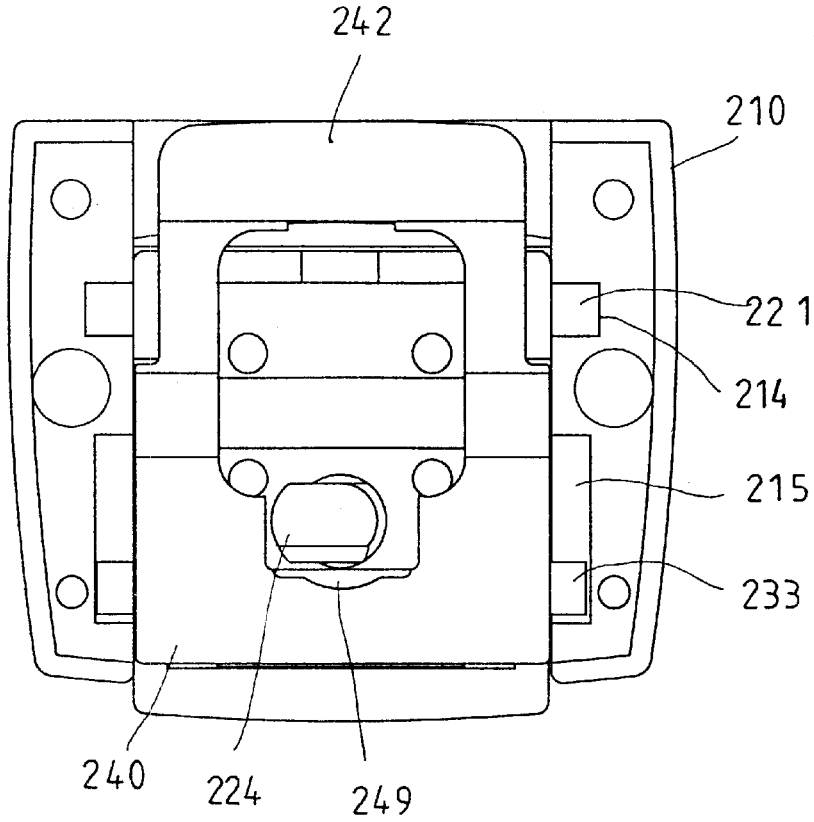
FIG. 3 is a rear view of the movable lock body assembly of the preferred embodiment of the present invention.
Figure 6:
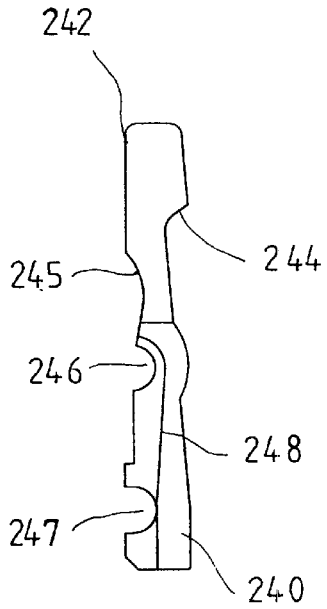
FIG. 6 is a side view of the sliding retainer of the preferred embodiment of the present invention.

The sliding retainer 240, as shown in FIGS. 1, 2, and 6, is a substantially rectangular member comprising an opening 241 in the middle, an inverted U-shaped front bar 242, a recessed portion 243 in the top side of the transversely extended middle section of the inverted U-shaped front bar 242, a beveled face 244 in the bottom side of the transversely extended middle section of the inverted U-shaped front bar 242, two recessed bearing portions 245 respectively disposed in the top side of the two longitudinally extended end sections of the inverted U-shaped front bar 242 near the front side, two rear receiving grooves 247 respectively disposed in the top side of the two longitudinally extended end sections of the inverted U-shaped front bar 242 near the rear side, two middle receiving grooves 246 respectively disposed in the top side of the two longitudinally extended end sections of the inverted U-shaped front bar 242 and spaced between the recessed bearing portions 245 and the rear receiving grooves 247, two recessed shoulder portions 248 respectively disposed in the top side of the two longitudinally extended end sections of the inverted U-shaped front bar 242 and longitudinally extended at one side of the middle receiving grooves 246 and the rear receiving grooves 247, and a recessed stop portion 249 in the rear side of the periphery of the opening 241. The sliding retainer 240 is covered with its top side over the back side of the actuating member 220, keeping the ends of the pivot axle 231 respectively positioned in the middle receiving grooves 246 and the coupling portions 233 of the arm rods 232 respectively coupled to the rear receiving grooves 247, and the arm rods 232 respectively rested in the recessed shoulder portions 248.

Figure 7:
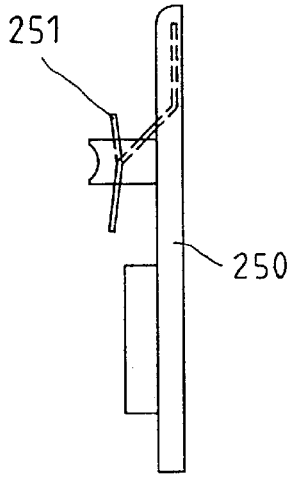
FIG. 7 is a side view of the back cover of the preferred embodiment of the present invention.

The back cover 250, as shown in FIG. 7, has a front spring plate 251 for pressing on the actuating member 220 to force the actuating member 220 against the front cover 210. The back cover 250 has its top side covered on the bottom side of the front cover 210, keeping the actuating member 220, the link 230 and the sliding retainer 240 positioned in the space defined within the front-cover 210 and the back cover 250.

Figure 8:
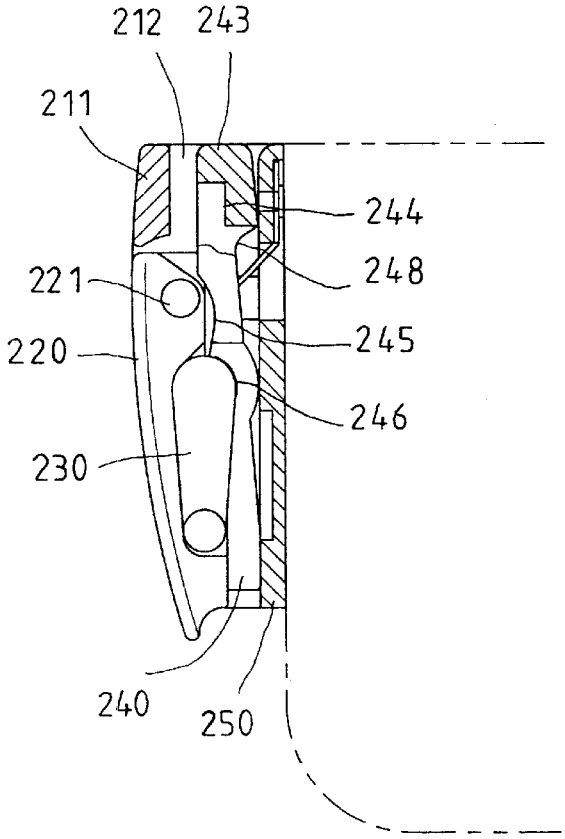
FIG. 8 is a side view showing the movable lock body assembly installed in the case according to the preferred embodiment of the present invention.

When in use, the actuating member 220 is disposed adjacent to the back cover 250, the sliding retainer 240 is completely received inside the movable lock body assembly 200, and the front sides of the front cover 210, sliding retainer 240 and back cover 250 of the movable lock body assembly 200 are maintained in flush with the top edge of the case as shown in FIG. 8. Therefore, the case lock has no protruded portion that may injure the user's hands or damage the storage items.

Figure 9:
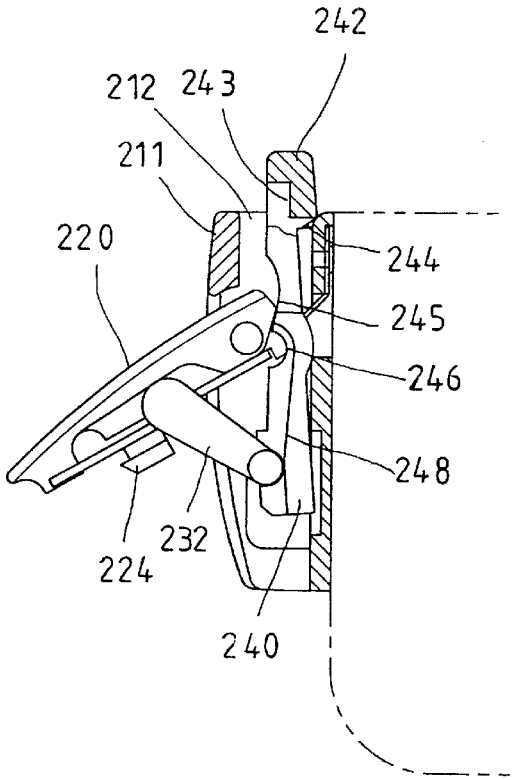
FIGS. 9–11 are similar to FIG. 8 but showing the movable lock body assembly operated in different postures.
Figure 10:
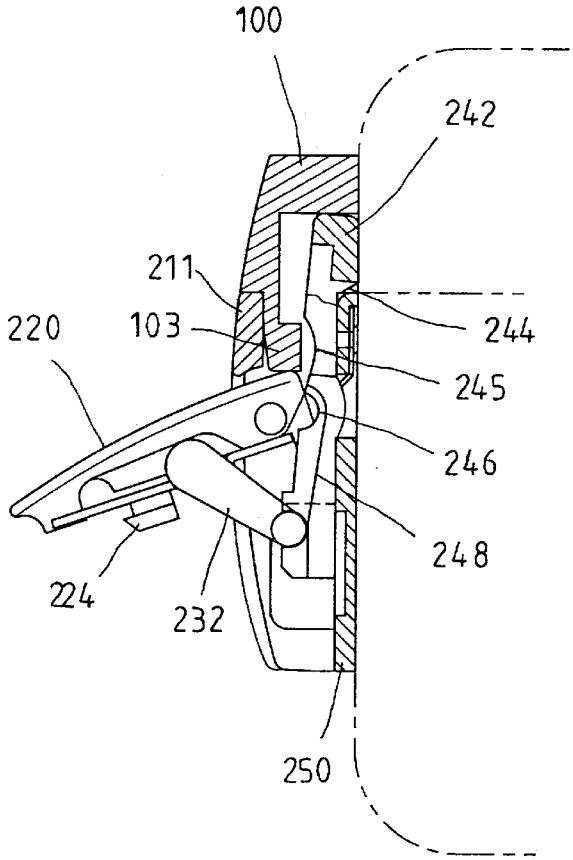
Figure 11:
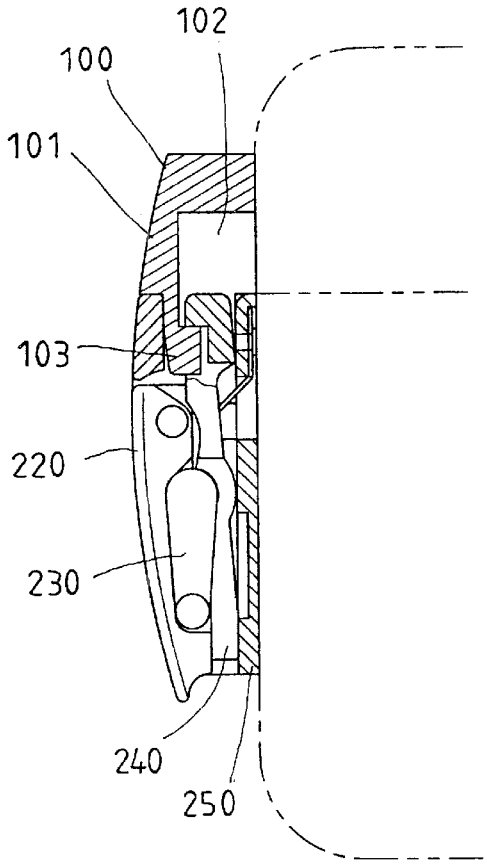
Figure 12:
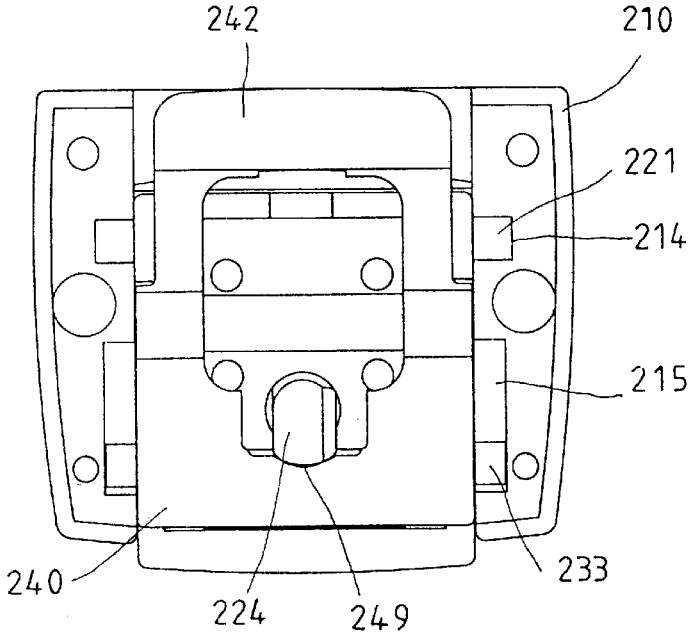
FIG. 12 is similar to FIG. 3 but showing the movable lock body assembly locked.

When closing the case, pull the actuating member 220 outwards to move the link 230 far away from the back cover 250. At this time, the arm rods 232 pull the coupling portions 233 of the arm rods 232 along the longitudinal sliding grooves 215 toward the front side of the front cover 210, thereby causing the sliding retainer 240 to be moved axially forwards as shown in FIG. 9. Following forward movement of the sliding retainer 240, the two ends of the front side of the actuating member 220 are moved backwards along the recessed bearing portions 245 of the sliding retainer 240, thereby causing the link 230 to push the sliding retainer 240 forwards to a predetermined distance when the actuating member 220 turned to the outer side. When the sliding retainer 240 pushed forwards by the link 230, the inverted U-shaped front bar 242 and the beveled face 244 are extended out of the movable lock body assembly 200. Because the front side of the sliding retainer 240 is tilted in direction toward the back cover 250 when the front side of the actuating member 220 moved along the recessed bearing portions 245 to the top, as shown in FIG. 10, the distance between the top side of the inverted U-shaped front bar 242 and the bottom side of the transverse shoulder 211 of the front cover 210 is relatively increased. Therefore, when the user closes the case, the fixed retaining member 100 is forced to engage its extension portion 101 into the receiving recess 212 of the transverse shoulder 211. When closed the case, the actuating member 220 is turned in the reversed direction to move the link 230 and the sliding retainer 240, thereby causing the inverted U-shaped front bar 242 to be moved with the sliding retainer 240 backwards to the inside of the movable lock body assembly 200 and received in the recessed receiving portion 102 of the fixed retaining member 100, and therefore the case is locked as shown in FIG. 11. At this time, the user can insert the key into the keyway 222, and then drive the key to rotate the lock cylinder 223, causing the swivel hook 224 to be moved from the transverse direction to the longitudinal direction and engaged into the recessed stop portion 249 in the rear side of the periphery of the opening 241 to lock the actuating member 220 and the sliding retainer 240.

What is claimed is:

1. A case lock comprising a fixed retaining member and a movable lock body assembly respectively fastened to the top and bottom cover shells of a case for locking said case, said fixed retaining member having an engagement block adapted for engaging into said movable lock body assembly when closing the top and bottom cover shells of said case, said movable lock body assembly comprising:

a front cover having a transverse shoulder which is provided in a bottom side thereof with a receiving recess, and two arms respectively extended from two ends of said transverse shoulder at right angles in same direction, said arms each having a coupling hole at an inner side;

an actuating member having two side pivots symmetrically disposed at two sides and respectively pivoted to the coupling holes of said front cover for enabling said actuating member to be received in between the arms of said front cover;

a sliding retainer having a top side covered on the back side of said actuating member, a middle opening, a front bar, a recessed portion in a top side of said front bar for engagement with the engagement block of said fixed retaining member, and a beveled face in a bottom side of said front bar;

a link pivoted between said actuating member and said sliding retainer and adapted to move said sliding retainer in an axial direction while the link is driven by the actuating member and moved along with said actuating member; and a back cover covered on the bottom side of said front cover, said back cover defining with said front cover a space, which receives said actuating member, said link, and said sliding retainer.

2. The case lock as claimed in claim 1, wherein said sliding retainer has two rear receiving grooves respectively disposed in two longitudinally extended end sections of said front bar.

3. The case lock as claimed in claim 2, wherein said link has one end pivoted to said actuating member and an opposite end pivoted to said rear receiving grooves of said sliding retainer.

4. The case lock as claimed in claim 3, wherein said sliding retainer comprises two recessed bearing portions, said two rear receiving grooves and two middle receiving grooves respectively disposed in said two longitudinally extended end sections of said front bar.

5. The case lock as claimed in claim 4, wherein said link has a pivot axle, two arm rods respectively connected to the ends of the pivot axle, and two coupling portions respectively connected to the ends of said two arm rods; wherein said sliding retainer is covered with the top side thereof on the back side of said actuating member such that the two ends of said pivot axle of said link are respectively disposed in the middle receiving grooves of said sliding retainer and an inner end of each of the coupling portions of said link is respectively disposed in the rear receiving grooves of said sliding retainer.

6. The case lock as claimed in claim 5, wherein said front cover comprises two longitudinal sliding grooves; the coupling portions of said link each having an outer end respectively positioned in the longitudinal sliding grooves of said front cover.

7. The case lock as claimed in claim 4, wherein said link comprises a pivot axle, two arm rods respectively connected to the ends of the pivot axle, and two coupling portions respectively connected to the ends of said two arm rods; wherein said pivot axle of said link is pivoted to the back side of said actuating member; wherein said front cover comprises two longitudinal sliding grooves; wherein the coupling portions of said link each has an outer end respectively positioned in the longitudinal sliding grooves of said front cover.

8. The case lock as claimed in claim 5, wherein said sliding retainer comprises two recessed shoulder portions respectively disposed in said two longitudinally extended end sections of said front bar at an outer side relative to said rear receiving grooves and said middle receiving grooves for the resting of the arm rods of said link.

9. The case lock as claimed in claim 1, wherein said fixed retaining member comprises an extension portion outwardly protruded from a middle part thereof, a recessed receiving portion formed in a bottom side of said extension portion; wherein said engagement block is downwardly protruded from a bottom side of said extension portion for insertion with said extension portion into said movable lock body assembly when closing said case.

10. The case lock as claimed in claim 1, wherein said actuating member comprises a keyway in a front side thereof, a lock cylinder in a back side thereof, and a swivel hook coupled to said lock cylinder.

11. The case lock as claimed in claim 10, wherein said sliding retainer has a recessed stop portion disposed in a rear side of the periphery of said middle opening for engagement with the swivel hook of said actuating member.

* * * * *

UNITED STATES PATENT AND TRADEMARK OFFICE

CERTIFICATE OF CORRECTION

PATENT NO. : 6,547,293 B1
DATED : April 15, 2003
INVENTOR(S) : Ching-Yuan Cheng

It is certified that error appears in the above-identified patent and that said Letters Patent is hereby corrected as shown below:

Title page,
Item [76], delete "Ching-Yuan Cheng, No. 64-5, Alley 70, Lane 419, Betiuen Rd. Betiuen Chiu, Taichung (TW)", and insert therefor -- Chin-Yuan Cheng, No. 50, Lane 138, Chiaoshiao St., Beituen Chiu, Taichung, Taiwan, R.O.C. --

Signed and Sealed this

Twenty-sixth Day of August, 2003

JAMES E. ROGAN
*Director of the United States Patent and Trademark Office*